US006515567B2

(12) United States Patent
Yeh et al.

(10) Patent No.: US 6,515,567 B2
(45) Date of Patent: Feb. 4, 2003

(54) BOBBIN FOR A TRANSFORMER

(75) Inventors: Ming Yeh, Taipei Hsien (TW); Heng Cheng Chou, Taipei Hsien (TW); Chen-Feng Wu, Taoyuan (TW); Chien-Chia Lin, Taoyuan (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/998,788

(22) Filed: Dec. 3, 2001

(65) Prior Publication Data

US 2002/0070832 A1 Jun. 13, 2002

(30) Foreign Application Priority Data

Dec. 12, 2000 (TW) ..... 89218849 U

(51) Int. Cl.[7] ..... H01F 27/29

(52) U.S. Cl. ..... 336/192; 336/198; 336/200

(58) Field of Search ..... 336/65, 90, 192, 336/198, 208, 180, 182, 200

(56) References Cited

U.S. PATENT DOCUMENTS 4,904,975 A * 2/1990 Medenbach ..... 336/192
4,939,494 A * 7/1990 Masuda et al. ..... 336/96
6,078,240 A * 6/2000 Huang ..... 336/90

* cited by examiner

*Primary Examiner*—Elvin Enad
*Assistant Examiner*—Tuyen T. Nguyen
(74) *Attorney, Agent, or Firm*—Birch, Stewart, Kolasch & Birch, LLP

(57) ABSTRACT

A bobbin for a transformer is provided. The bobbin comprises a body, a first partition wall, a second partition wall, at least one third partition wall, and two first pins. The first partition wall, having a first protrusion, is formed on the body. The body is divided into a primary side and a secondary side by the first partition wall. The second partition wall, having a second protrusion with a thinner section, is formed on the secondary side of the body. The third partition wall, having a third protrusion with a notch, is formed on the secondary side of the body so that the third partition wall is close to the second partition wall and away from the first partition wall. The first pins are disposed on the secondary side of the body in a substantially U-shape.

12 Claims, 4 Drawing Sheets

BOBBIN FOR A TRANSFORMER

BACKGROUND OF THE INVENTION

1 Field of the Invention

The invention relates to a bobbin; in particular, the invention relates to a bobbin for a transformer.

2 Description of the Related Art

A conventional bobbin 10 for a transformer is shown in FIG. 1*a* and FIG. 1*b*. The bobbin 10 comprises a body 20, a first partition wall 30*a* and a plurality of second partition walls 30*b*. The body 20 receives a bar core (not shown). A wire (not shown) fills the body 20. The body 20, the bar core and the wire constitute the transformer. The first partition wall 30*a* and the second partition walls 30*b* are formed on the body 20. The body 20 is divided into a primary side 21 and a secondary side 22 by the first partition wall 30*a*. The wire comprises a first wire (not shown), filling the primary side 21 of the body 20, and a second wire 60 filling the secondary side 22 of the body 20.

Referring to FIG. 1*a* and FIG. 1*b*, the body 20 is provided with a plurality of winding grooves 34, separated by the second partition walls 30*b*, on the secondary side 22. Each of the second partition walls 30*b* is provided with a wire-guiding breach 31 and a protrusion 33, as shown in FIG. 1*a*, or a notch 35 as shown in FIG. 1*b*. It is noted that all of the protrusions 33 are arranged in line, on the same side and the same level. Also, all of the notches 35 are arranged in line, on the same side and the same level.

A plurality of pins 50 are disposed on the secondary side 22 of the body 20. One of the pins 50 is used as a starting terminal 50*a*, and one of the pins 50 is used as an ending terminal 50*b*. The starting end of the second wire 60 attaches to the starting terminal 50*a*, and the terminal end of the second wire 60 attaches to the ending terminal 50*b*. Between the second wire 60 attached to starting terminal 50*a* and the second wire 60 attached to ending terminal 50*b*, the second wire 60 fills the grooves 34 of the body 20 to form a winding (not shown). After the number of windings located in one of the grooves 34, reaches a set number, the second wire 60 enters the next groove 34 through the breach 31 to continue the winding. Thus, a transformer with variable voltage is formed. To simplify the drawings, FIG. 1*a* and FIG. 1*b* simply show the second wire 60 adjacent to the starting terminal 50*a* and the ending terminal 50*b*, and the second wire filling the grooves is omitted.

After the second wire fills the grooves and forms a winding, the terminal end of the second wire is far from the ending terminal 50*b*. It is very dangerous to attach the terminal end of the second wire 60 to the ending terminal 50*b* without any support. When the terminal end of the second wire 60, far from the ending terminal 50*b*, is attached to the ending terminal 50*b* without any support, the second wire 60 is liable to be broken. In addition, the second wire 60, adjacent to the ending terminal 50*b*, is near the outmost portion of the winding that has the highest voltage. Thus, even though the second wire 60 is not broken, this portion of the second wire 60 is likely to experience short circuit due to its contact with the highest voltage of the winding resulted from undesired displacement.

To solve the above problems, various designs have been provided. In one of these designs, the second wire 60 is additionally twisted before it is attached to the ending terminal 50*b*. By twisting, the strength of the second wire 60 increases so as to avoid breaking. However, this design requires an additional twisting step, and still cannot properly hold the second wire 60.

Alternatively, in another design as shown in FIG. 1*a* and FIG. 1*b*, the second wire 60 can be held by the protrusions 33, or the second wire 60 can be supported by the notches 35. While the notches 35 can support the second wire 60 in certain circumstances, they cannot fix the second wire 60 securely. For instance, the notches 35 can simply prevent the displacement of the second wire 60 resulting from the external force along an arrow $X_1$ in FIG. 1*b*, but they cannot prevent the displacement of the second wire 60 resulted from the external force along an arrow $X_2$ in FIG. 1*b*. The protrusions 33 may hold the second wire 60, but they cannot fix the second wire 60 properly.

SUMMARY OF THE INVENTION

In order to address the disadvantages of the aforementioned bobbin, the invention provides a bobbin that can fix a wire properly without twisting the wire.

Accordingly, the bobbin of this invention comprises a body, a first partition wall, a second partition wall, at least one third partition wall, and two first pins. The first partition wall, having a first protrusion, is formed on the body. The body is divided into a primary side and a secondary side by the first partition wall. The second partition wall, having a second protrusion with a neck portion, is formed on the secondary side of the body. The third partition wall, having a third protrusion with a notch, is formed on the secondary side of the body so that the third partition wall is close to the second partition wall and away from the first partition wall. The first pins are disposed on the secondary side of the body in a substantially U-shape.

Furthermore, the second partition wall is provided with two first breaches. The third partition wall is provided with two second breaches corresponding to the first breaches respectively. Each of the second breaches is aligned with the corresponding first breach respectively.

Furthermore, the body is provided with two slots adjacent to the first pins respectively. The third protrusion has a first surface, the neck portion has a second surface, and the first surface is flush with the second surface.

Furthermore, each of the first pins is provided with a first arm, a second arm and a connecting section connecting the first arm and the second arm, and the connecting section is disposed outside the body. The first arm is provided with a step portion.

Furthermore, the secondary side of the body is provided with a plurality of grooves. The second partition wall is parallel with the first partition wall. The bobbin comprises a plurality of second pins disposed on the primary side of the body.

BRIEF DESCRIPTION OF THE DRAWINGS

The invention is hereinafter described in detail with reference to the accompanying drawings in which.

DETAILED DESCRIPTION OF THE INVENTION

Figure 1A:
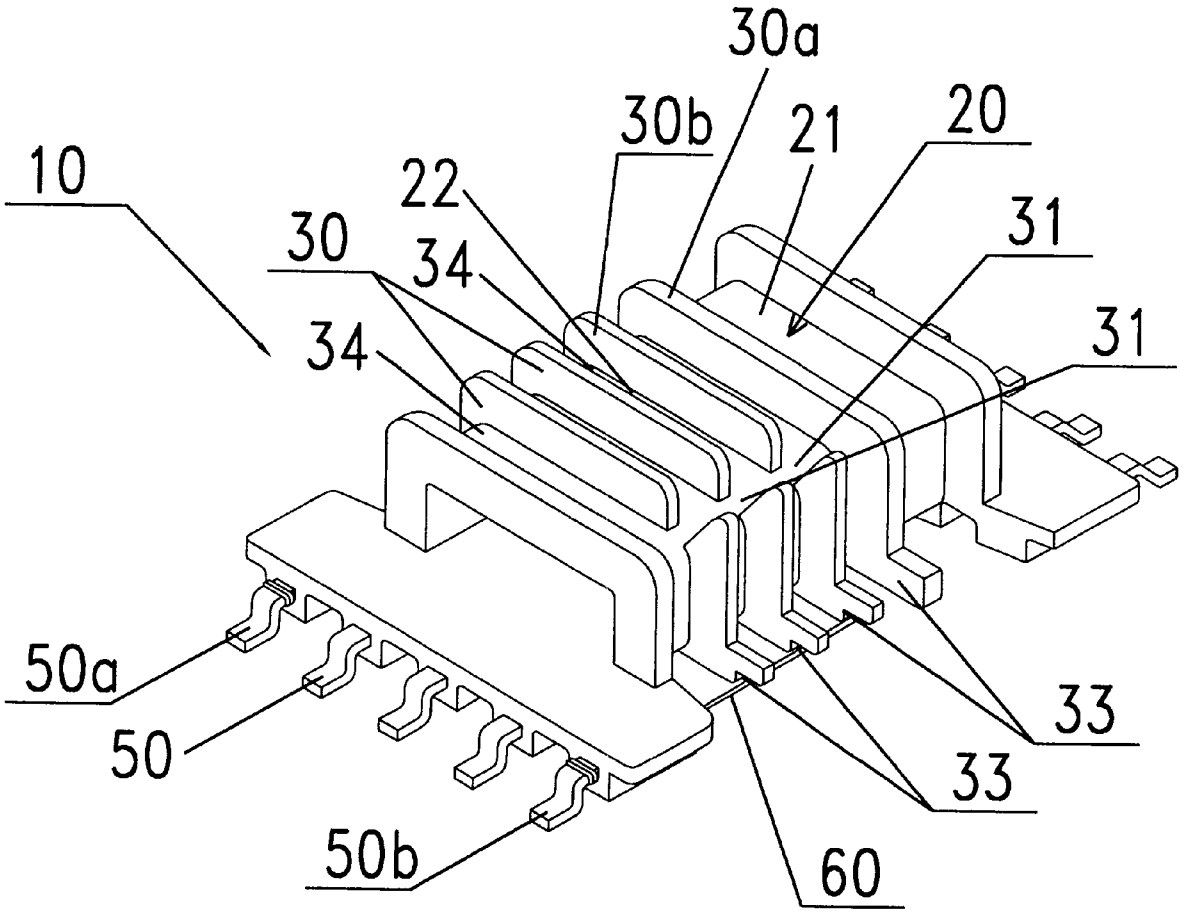
FIG. 1a (PRIOR ART)
FIG. 1*a* is a schematic view depicting a conventional bobbin.
Figure 1B:
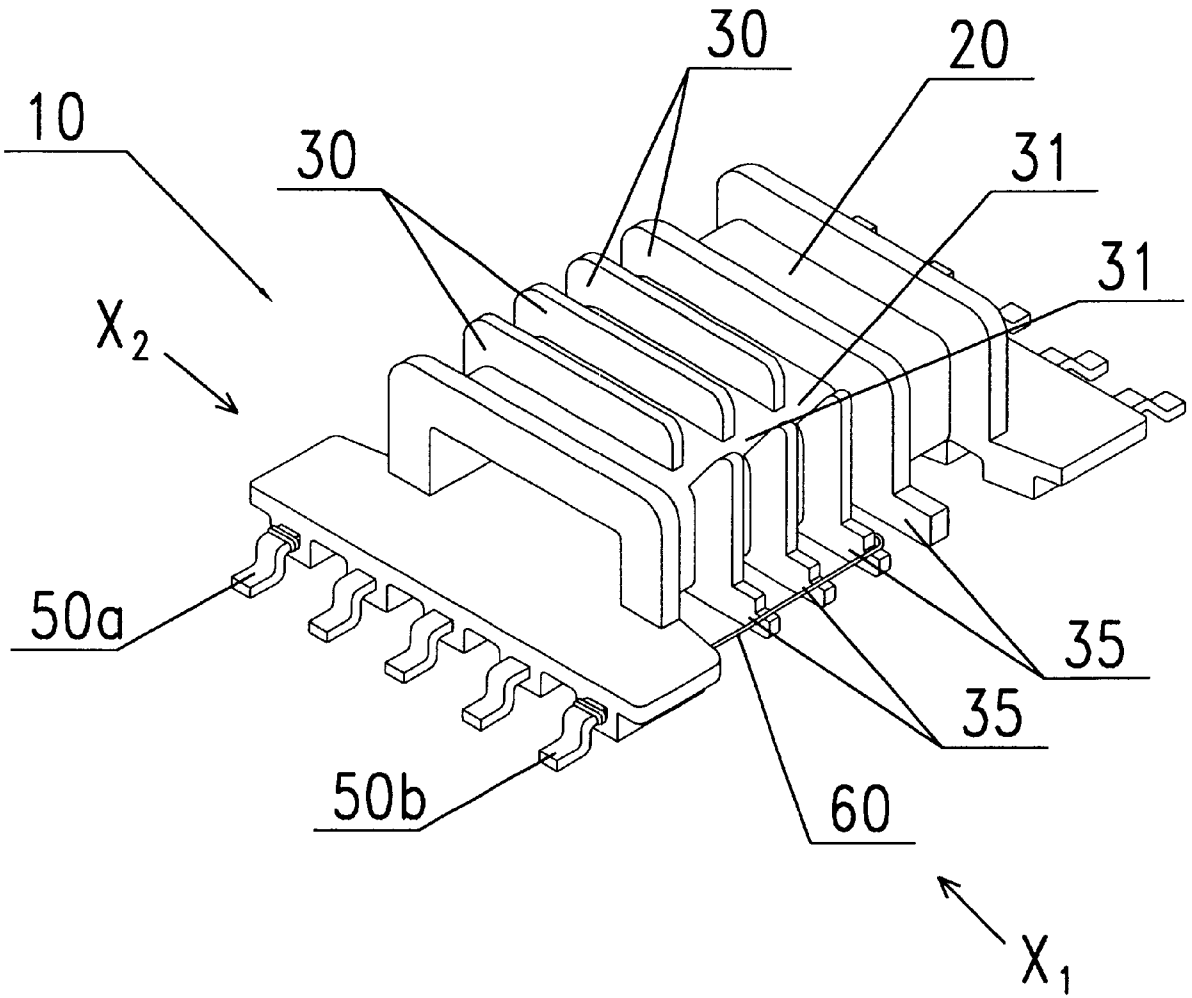
FIG. 1b (PRIOR ART)
FIG. 1*b* is a schematic view depicting another conventional bobbin.
Figure 2:
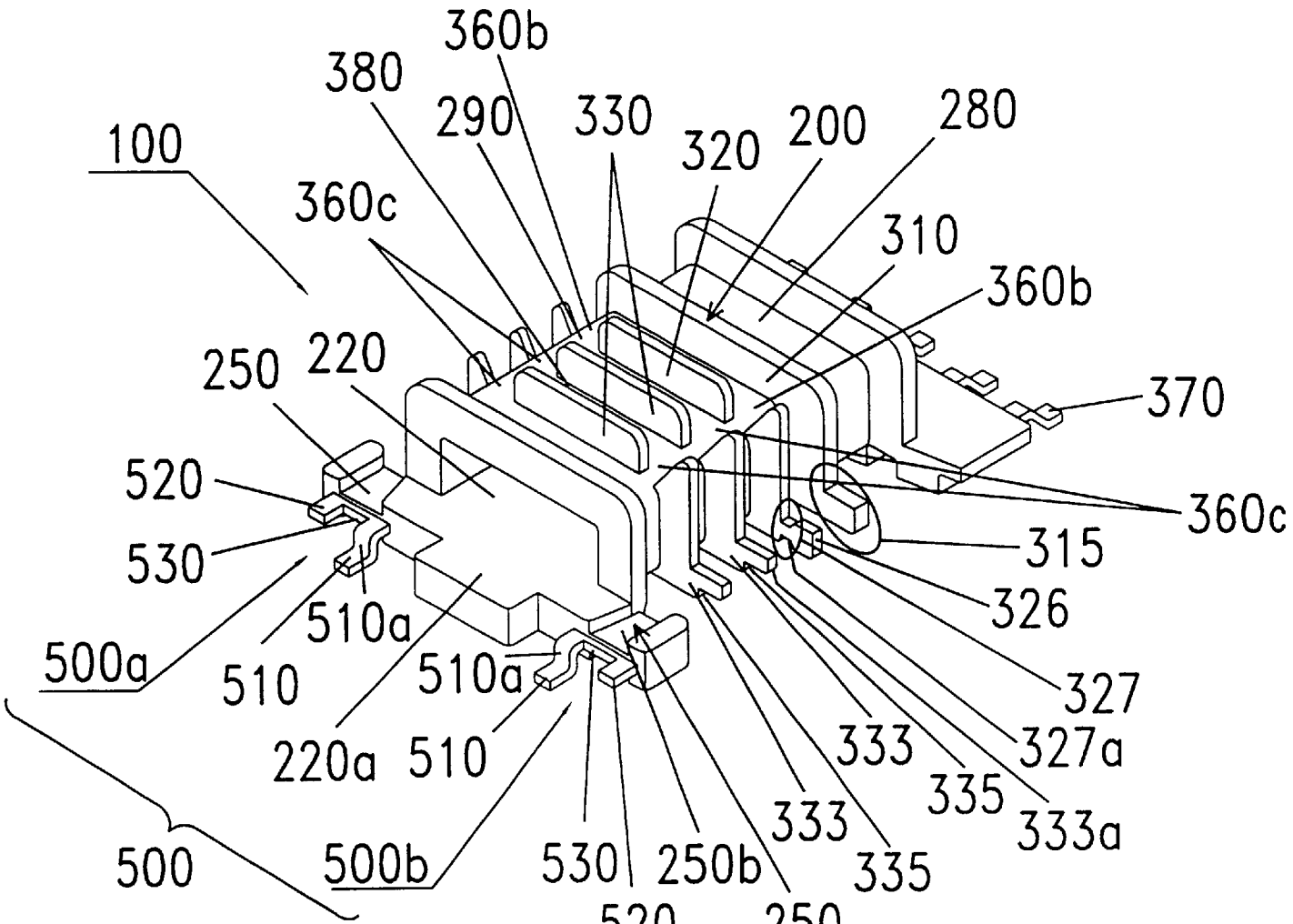
FIG. 2 is a schematic view depicting a bobbin as disclosed in this invention.
Figure 3:
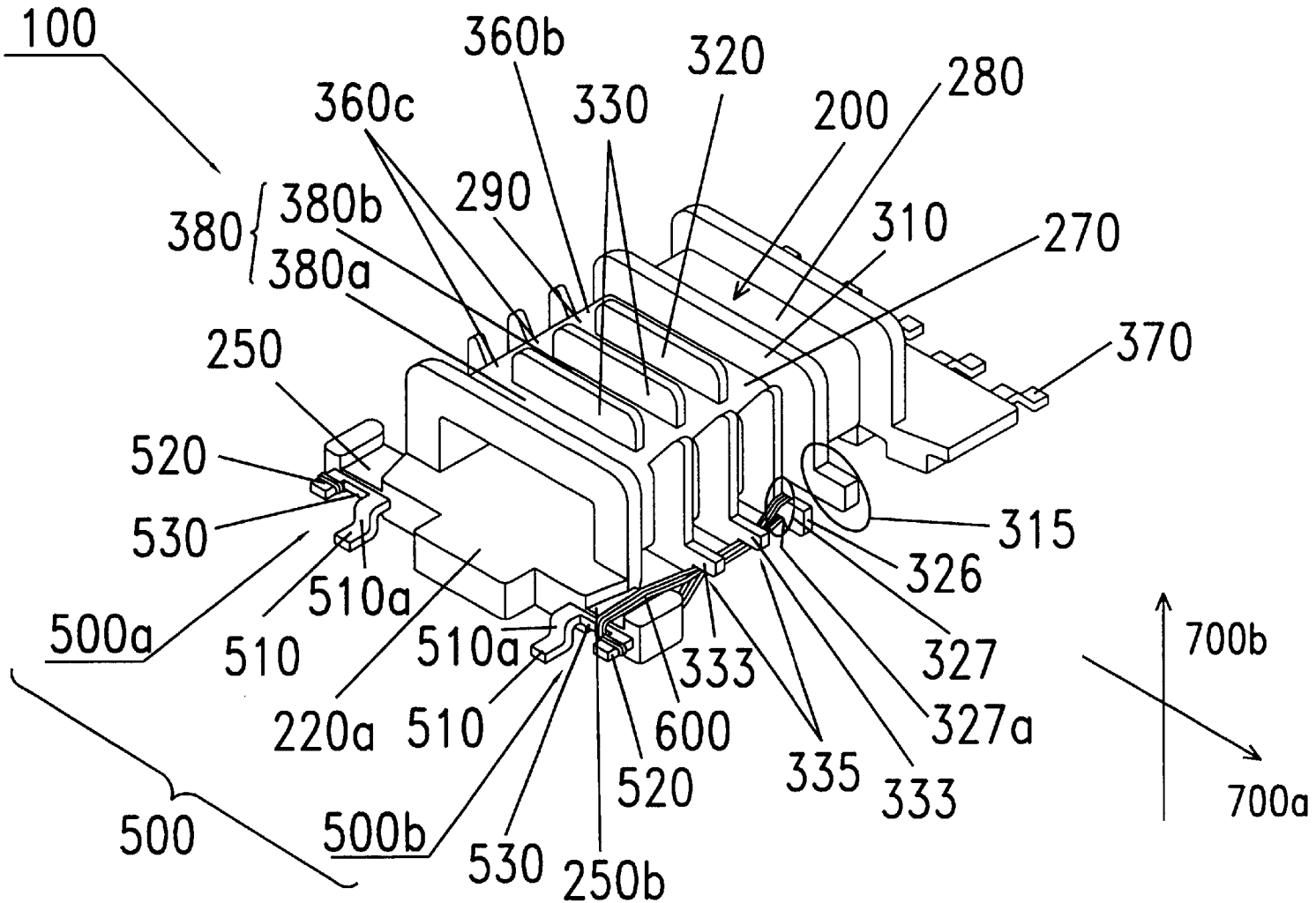
FIG. 3 is a schematic view depicting a bobbin, with a filling wire, as shown in FIG. 2.

Referring to FIG. 2, a bobbin 100 of this invention comprises a body 200, a first partition wall 310, a second partition wall 320, two third partition walls 330, two first pins 500 and a plurality of second pins 370. The body 200 is provided with two slots 250 adjacent to the first pins 500 respectively. The slots 250 are lower than a lower surface 220*a* of a channel 220, for receiving a bar core (not shown), of the body 200. A wire (not shown) fills the body 200. The body 200, the bar core and the wire constitute a transformer. The first partition wall 310, the second partition wall 320 and the third partition walls 330 are formed on the body 200. The body 200 is divided into a primary side 280 and a secondary side 290 by the first partition wall 310. The secondary side 290 of the body 200 is provided with a plurality of grooves 380 by the second partition wall 320 and the third partition walls 330. The wire comprises a first wire (not shown), filling the primary side 280 of the body 200, and a second wire 600 filling the secondary side 290 of the body 200. Part of the second wire 600 is shown in FIG. 3.

The second partition wall 320 is formed on the secondary side 290 of the body 200 parallel with the first partition wall 310. The second partition wall 320 is provided with two first breaches 360*b* and a second protrusion 326. The second protrusion 326 is provided with a neck portion 327, and the neck portion 327 is narrower than the other portion of the second protrusion 326.

Each of the third partition walls 330 is formed on the secondary side 290 of the body 200 so that the third partition wall 330 is close to the second partition wall 320 and away from the first partition wall 310. That is, from the primary side 280 to the secondary side 290, the first partition wall 310, the second partition wall 320 and the third partition walls 330 are arranged in order. Each of the third partition walls 330 is provided with two second breaches 360*c*, corresponding to the first breaches 360*b* respectively, and a third protrusion 333. The third protrusion 333 is provided with a notch 335 to form a first surface 333*a*. Each of the second breaches 360*c* is aligned with the corresponding first breach 360*b* respectively. Also, the first surface 333*a* is flush with a second surface 327*a* of the neck portion 327.

The first pins 500 are disposed on the secondary side 290 of the body 200 in a substantially U-shape. Each of the first pins 500 is provided with a first arm 510, a second arm 520 and a connecting section 530 connecting the first arm 510 and the second arm 520. The connecting section 530 is disposed outside the body 200. Each of the first arms 510 is provided with a step portion 510*a*.

Referring to FIG. 3, one of the first pins 500 is used as a starting terminal 500*a*, and the other first pin 500 is used as an ending terminal 500*b*. The starting end of the second wire 600 attaches to the starting terminal 500*b*, and the terminal end of the second wire 600 attaches to the ending terminal 500*b*.

When the second wire 600 extends from the starting terminal 500*a* to the ending terminal 500*b*, the second wire 600 fills the groove 380*a*, adjacent to the first pins 500, to form a winding (not shown). After the windings located in the grooves 380*a* reaches a set number, the second wire 600 enters the next groove 380*b* through the first breach 360*b* or the second breach 360*c* to fill the next groove 380*b* and continue the winding. Thus, a transformer with variable voltage value is formed. To simplify the drawing, FIG. 3 simply shows the second wire 600 adjacent to the first pins 500, and the second wire 600 filling the grooves 380 is omitted.

After the second wire 600 fills all of the grooves 380, it attaches to the ending terminal 500*b* through the second surface 327*a* of the neck portion 327, the notch 335 and a lower surface of the slot 250. Then, the second wire 600 returns to the second partition wall 320 to repeat the above wire-filling step through the connecting section 530, an upper surface 250*b* of the slot 250, the notch 335. Finally, the second wire 600 is attached to the second arm 520. Thus, the second wire 600 is supported and fixed properly by filling the slot 250 and the neck portion 327. Also, the second wire 600 is safe from unwinding.

As stated above, since the second wire 600 fills the slot 250 and the neck portion 327, it can be supported and fixed in all circumstance. That is, the second wire 600 can prevent displacement resulting from the external force along an arrow 700*a* and an arrow 700*b* in FIG. 3. As a result, the second wire 600 is not likely to experience breakage, or short circuit due to undesired displacement. In addition, since the second wire 600 is supported and fixed properly, it does not require twisting before attachment to the ending terminal 500*b*. Therefore, the twisting step can be omitted.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A bobbin for a transformer comprising:

a body;

a first partition wall, having a first protrusion, formed on the body wherein the body is divided into a primary side and a secondary side by the first partition wall;

a second partition wall, having a second protrusion with a neck portion, formed on the secondary side of the body;

at least one third partition wall, having a third protrusion with a notch, formed on the secondary side of the body so that the third partition wall is close to the second partition wall and away from the first partition wall; and two first pins disposed on the secondary side of the body.

2. The bobbin as claimed in claim 1, wherein the second partition wall is provided with two first breaches.

3. The bobbin as claimed in claim 2, wherein the third partition wall is provided with two second breaches corresponding to the first breaches respectively.

4. The bobbin as claimed in claim 3, wherein each of the second breaches is aligned with the corresponding first breach respectively.

5. The bobbin as claimed in claim 1, wherein the body is provided with two slots adjacent to the first pins respectively.

6. The bobbin as claimed in claim 1, wherein the third protrusion has a first surface, the neck portion has a second surface, and the first surface is flush with the second surface.

7. The bobbin as claimed in claim 1, wherein each of the first pins is provided with a first arm, a second arm and a connecting section connecting the first arm and the second arm, and the connecting section is disposed outside the body.

8. The bobbin as claimed in claim 7, wherein each of the first pins is a substantially U-shape.

9. The bobbin as claimed in claim 7, wherein the first arm is provided with a step portion.

10. The bobbin as claimed in claim 1, wherein the secondary side of the body is provided with a plurality of grooves.

11. The bobbin as claimed in claim 1, wherein the second partition wall is parallel with the first partition wall.

12. The bobbin as claimed in claim 1, further comprising:

a plurality of second pins disposed on the primary side of the body.

* * * * *